United States Patent [19]

Nichols

[11] Patent Number: 4,665,935

[45] Date of Patent: May 19, 1987

[54] FLEXIBLE ARCUATE TENT FEATURING PEAK CORD SUSPENSION

[76] Inventor: Philip T. Nichols, 4399 Walter Way, West Valley City, Utah 84120

[21] Appl. No.: 732,496

[22] Filed: May 9, 1985

[51] Int. Cl.[4] ..... E04H 15/40; E04H 15/54; E04H 15/64

[52] U.S. Cl. ..... 135/104; 135/116; 135/119

[58] Field of Search ..... 135/90, 101, 102, 104, 135/105, 113, 116, 905, 119

[56] References Cited

U.S. PATENT DOCUMENTS

| | | | |
|---|---|---|---|
| 2,134,879 | 11/1938 | Levy | 135/105 X |
| 2,543,684 | 2/1951 | Blanchard | 135/105 X |
| 2,938,524 | 5/1960 | Benson | 135/105 X |
| 3,547,136 | 12/1970 | Prinz | 135/90 X |
| 3,896,830 | 7/1975 | Sharick | 135/116 X |
| 4,192,333 | 3/1980 | Sato | 135/104 X |
| 4,305,414 | 12/1981 | Bareis | 135/116 |
| 4,352,362 | 10/1982 | Nichols | 135/98 |

*Primary Examiner*—Robert A. Hafer
*Assistant Examiner*—D. Neal Muir
*Attorney, Agent, or Firm*—J. Winslow Young

[57] ABSTRACT

A tent apparatus and method, the tent apparatus including a fabric tent shell having a plurality of side walls joined in seams along adjacent edges and a fabric floor joined to the bottom edges of the side walls. A tent pole-receiving sleeve is formed as an integral part of each seam. The tent shell is supported inside a foldable frame having a plurality of tent poles joined in a coupling at an apex and ribs extending laterally between the tent poles. Each tent pole is inserted in a sleeve and the fabric tent shell is mounted to the foldable frame by a unique cord/pulley system which places the fabric tent shell under tension adjacent the coupling and adjacent the base of each tent pole when the frame is extended while providing ample slack when the frame is folded. The fabric tent shell and foldable frame are thus integrally joined into a unitary, man-portable, and erectable tent structure.

9 Claims, 6 Drawing Figures

FLEXIBLE ARCUATE TENT FEATURING PEAK CORD SUSPENSION

BACKGROUND

1. Field of the Invention

This invention relates to tents and, more particularly, to a novel tent apparatus and method, the apparatus including a foldable frame and a unique system for suspending a fabric tent shell within the foldable frame.

2. The Prior Art

Various foldable tent structures whereby the support frame and the fabric tent shell are erectable and foldable as a unitary structure are known in the art. These prior art structures are primarily directed toward novel systems for erecting and folding or collapsing the frame. For example, two types of framing structures are shown in each of U.S. Pat. Nos. 3,168,101 and 3,834,410. The former patent is relevant in that it discloses an external frame for a tent while the latter patent relates to a collapsible tent structure wherein the framework is fabricated with spring-loaded cables passing through the center of hollow pole elements. A similar folding tent is also shown in U.S. Pat. No. 2,543,684. U.S. Pat. No. 1,590,213 discloses a tetrahedral-shaped tent having a rigid pole at each corner of the tetrahedral configuration.

U.S. Pat. Nos. 1,502,898 and 3,794,054 relate to tent structures which are generally referred to in the art as umbrella-type tents. In particular, the lateral spars or ribs of the "umbrella" structure intersect with downwardly extending legs to provide the roof support structure for the tent.

An improvement over the foregoing tent structures is the tent apparatus and method disclosed in my patent (U.S. Pat. No. 4,352,362) which details several novel features for a unitary, erectable tent structure. However, continued development has caused me to become aware of the fact that it is desirable to reduce the size of the sleeves 24–27 and thus the amount of fabric contained therein while bringing tent poles 20–23, respectively, inwardly closer to the surface of fabric tent shell 12. This, in turn, creates an additional problem in that there is not enough slack in tent shell 12 to permit release and folding of the various segments of tent poles 20–23 when these tent poles are brought together upon release of ribs 40 and 41. Further, the orientation of tabs 50–56 and the forces exerted on the corresponding sleeves 20–26 creates a tendency for floor 14 to be pulled upwardly. Assembly of this tent structure was complicated by the fact that it was necessary to assemble the tent poles after insertion into sleeves 24–26 due to sleeve segments 24*a* and 25*a* extending above the location of ribs 40 and 41.

In view of the foregoing, it would be an advancement in the art to provide a foldable tent structure wherein the fabric tent shell is uniformly and tautly supported within a foldable frame and wherein the foldable frame is readily mounted to the fabric tent shell in close-fitting relationship. Such a novel tent apparatus and method is disclosed and claimed herein.

BRIEF SUMMARY AND OBJECTS OF THE INVENTION

This invention relates to a novel tent apparatus and method, the tent apparatus including a foldable frame with a fabric tent shell supported therein. The fabric tent shell includes a plurality of fabric side walls joined along adjacent edges in a seam. A tent pole-receiving sleeve is included as an integral part of the seam. A cord/pulley system is mounted between the frame and the fabric tent shell for imparting the desired amount of tension to the fabric tent shell when the foldable frame is extended in the open position and, correspondingly, providing sufficient slack between the fabric tent shell and the tent poles to permit the tent poles to be separated into segments during folding of the tent structure.

It is, therefore, a primary object of this invention to provide improvements in tent structures.

It is another object of this invention to provide an improved method for supporting a fabric tent shell in a foldable tent frame.

Another object of this invention is to provide a foldable tent structure with a novel suspension system for suspending a fabric tent shell inside a foldable frame.

Another object of this invention is to provide an improved method for fabricating a foldable tent structure from a foldable frame and a fabric tent shell.

Another object of this invention is to provide an improved foldable tent structure wherein a foldable framework for the tent is assembled prior to attachment to the fabric tent shell.

These and other objects and features of the present invention will become more fully apparent from the following description and appended claims taken in conjunction with the accompanying drawing.

DETAILED DESCRIPTION OF THE PREFERRED EMBODIMENTS

Figure 1:
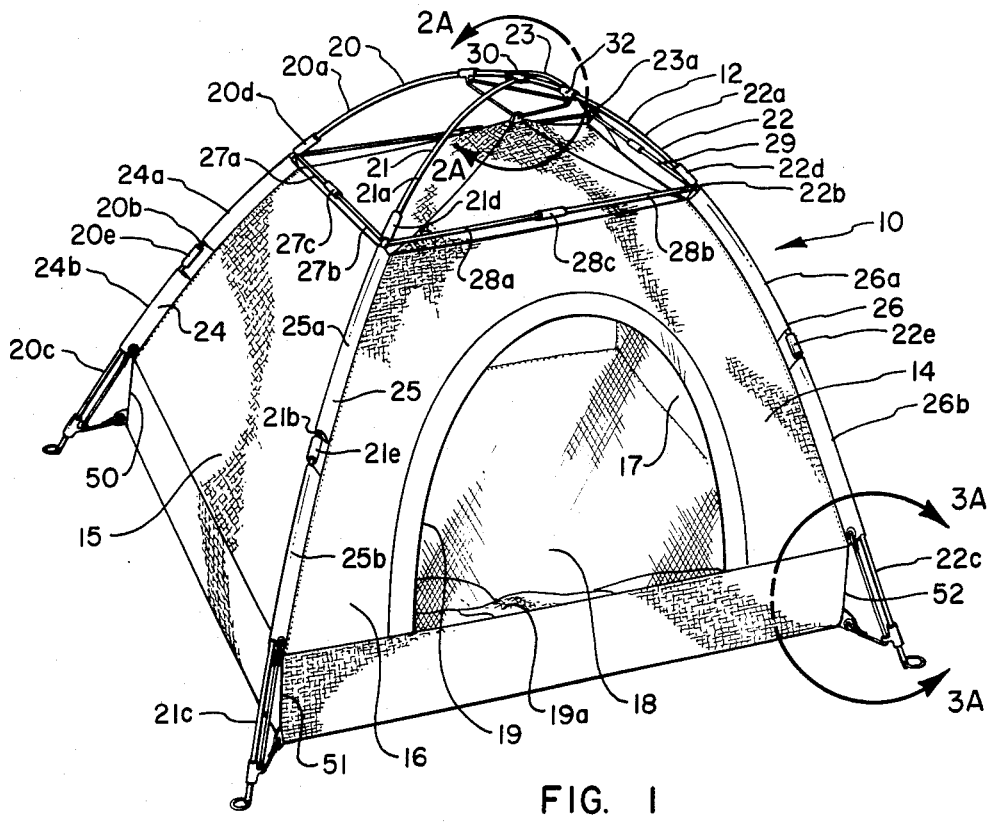
FIG. 1 is a perspective view of a presently preferred embodiment of the novel tent apparatus of this invention shown in the erected state.

The invention is best understood by reference to the drawing wherein like parts are designated with like numerals throughout.

The Apparatus

Referring now more particularly to the drawing, the novel tent apparatus of this invention is shown generally at 10 and includes a foldable tent frame 12 and a fabric tent shell 14 suspended therein. Fabric tent shell 14 is prepared from a plurality of fabric side walls 15–17 joined along adjacent edges into seams and integral sleeves 24–26. A fabric tent floor 18 is secured to the bottom edges of fabric side walls 15–17 to complete the structure of fabric tent shell 14. A doorway 19 is formed in side wall 16 and is closed by a fabric door 19*a* (shown open for ease of illustration).

Foldable frame 12 is configured from tent poles 20–23 joined at an apex in a coupling 30 and having lateral ribs 27–29 joining the respective, adjacent tent poles. Each of tent poles 20–23 is prepared from pole segments 20*a*–20*c*, 21*a*–21*c*, and 22*a*–22*c*, joined through pole joints 20*d* and 20*e*, 21*d* and 21*e*, and 22*d* and 22*e*, respectively. Tent poles 20–23 are known in the art and are prepared from tubular elements having an elastic cord (not shown) under tension and passing through the lumen thereof. Pole joints 20*d*, et seq., are simply hollow sockets into which the respective pole segments are releasably held by the tension of the elastic cord. Folding of the respective tent poles is accomplished by pulling the respective pole segments apart at the joints and folding the same as is conventional with this type of equipment.

Figure 2A:
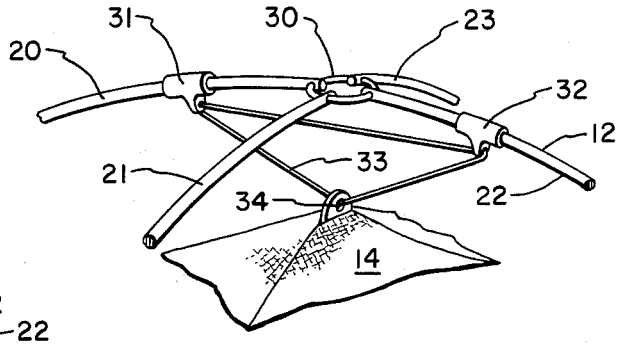
FIG. 2A is an enlargement of a fragment of FIG. 1.

Referring now more particularly to FIG. 2A, a first preferred embodiment of the upper support system for suspending fabric tent shell 14 inside foldable frame 12 is shown and includes mounts 31 and 32 secured at spaced relationship to tent poles 20 and 22, respectively. A cord 33 slidably passes through each of mounts 31 and 32 in a pulley-like relationship and is engaged to fabric tent shell 14 at an apex tab 34. Foldable frame 12 is shown extended. Folding of tent poles 20–23 downwardly into a generally parallel position provides slack in cord 33 in an amount proportional to the angular orientation formed in cord 33. This slack in addition to that provided by bringing mounts 31 and 32 into a downward, essentially adjacent position, relaxes a substantial portion of the tension on fabric tent shell 14.

Figure 2B:
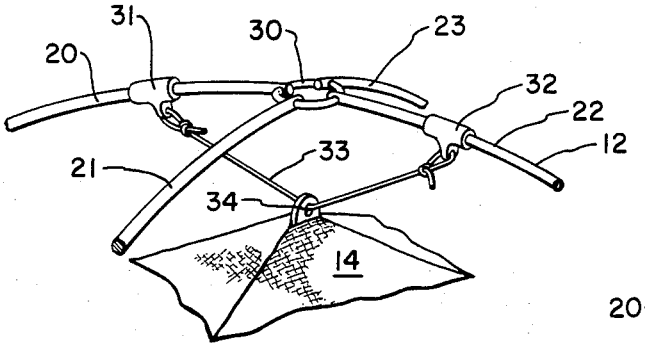
FIG. 2B is a first alternative configuration for the upper coupling shown in FIG. 2A.

An alternative suspension embodiment is shown at FIG. 2B wherein cord 33 is shown fixed at each end to mounts 31 and 32 while slidingly engaging apex tab 34 in a pulley-like relationship. Sliding or pulley-like engagement in either configuration (FIG. 2A or FIG. 2B) is advantageous in that it readily accommodates slight imperfections in the fabrication of fabric tent shell 14 and foldable frame 12. The effective relaxation length for cord 33 as shown in FIG. 2B is slightly shorter since it is decreased by an amount equivalent to one-half the length of cord 33 extending between mounts 31 and 32 as shown in FIG. 2A.

Figure 2C:
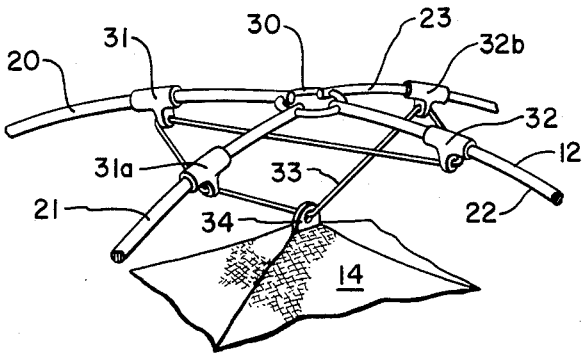
FIG. 2C is a second alternative configuration for the upper coupling shown in FIG. 2A.

With reference to FIG. 2C, cord 33 is shown affixed to apex tab 34 and slidingly engaged in a pulley-like relationship to a plurality of mounts, mount 31 on pole 20, mount 31*a* on pole 21, mount 32 on pole 22, and mount 32*a* on pole 23. The action of folding foldable tent frame 12 increases the effective vertical length of cord 33 by an amount approximately equivalent to the perimeter of the polygonal figure formed by cord 33 in its orientation sequentially from apex tab 34 to mounts 34, 31A, 31, 32, 32B and 34 and return to apex tab 34. Thus, it can be readily seen that substantial relaxation or slack can be created in cord 33 to provide a substantial separation between fabric tent shell 14 and foldable frame 12.

Figure 3A:
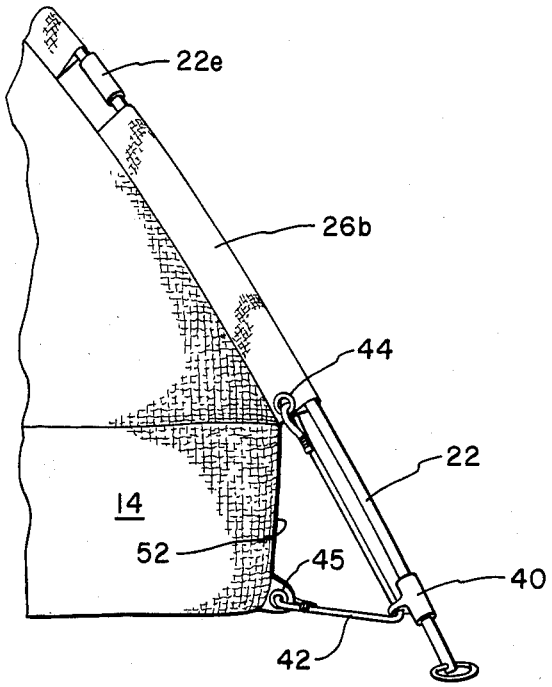
FIG. 3A is an enlarged, fragmentary view of FIG. 1.
Figure 3B:
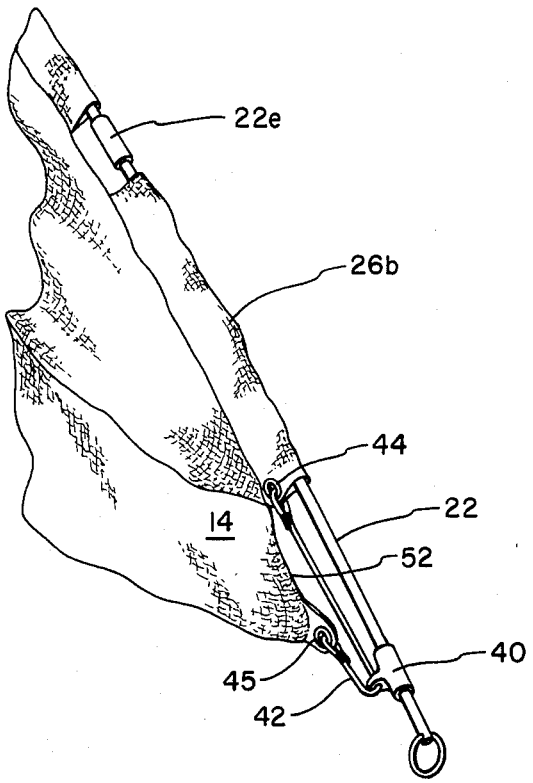
FIG. 3B is a schematic illustration of the view of FIG. 3A in the partially folded configuration.

Supplemental tension/slack for the lower perimeter of fabric tent shell 14 is provided through cord 42 as shown in the enlarged details of FIGS. 3A and 3B. Cord 42 is attached to fabric tent shell 14 at attachment 44 adjacent the bottom of sleeve 26B and to a floor tab 45 while slidingly passing in a pulley-like relationship through a pole mount 40 on the lower end of tent pole 22. When tent 10 is folded as shown in the fragmentary portion illustrated in FIG. 3B, cord 42 is effectively increased in length as a function of the angle formed by cord 42 between attachment 44 and floor tab 45. Further, upon erection of tent 10 (FIG. 3A), cord 42, by reason of its sliding engagement with pole mount 40 in its pulley-like action, adjusts for tension differences at attachment 44 and floor tab 45 as necessary to preclude lifting of floor 18 as discussed hereinbefore.

Each of the seams for sleeves 24, 25, and 26 is modified at their lower ends by vertical seams 50–52, respectively, which provide a vertical section to the base of tent side walls 15 and 16 (FIG. 1). This configuration accommodates tent poles 20–23 lying close to the surface of fabric tent shell 14 in sleeves 24–26, respectively, while providing the desired separation between the respective pole mount (pole mount 40, FIGS. 3A and 3B) so as to allow cord 42 sufficient relaxation distance to supplement relaxation of fabric tent shell 14 as discussed hereinbefore. Further, the effective floor space versus tent frame area is increased since it is no longer necessary to provide the relatively wide spatial separation between the tent poles and the fabric tent shell as shown in U.S. Pat. No. 4,352,363. A further advantage is that the volume of fabric tent shell 14 more closely approximates that of foldable frame 12, thereby providing savings in materials of construction.

The Method

The novel tent apparatus of this invention is assembled by obtaining a plurality of tent poles 20–23 and joining the same at coupling 30. Ribs, such as ribs 27 and 28, are mounted laterally between the respective tent poles to complete the assembly of foldable frame 12.

Fabric tent shell 14 is fabricated by sewing together a plurality of fabric side walls 15–17 with sleeves 24–26 formed as an integral part of the respective seams. Sleeves 24–26 are prepared in segments so as to permit access to the respective joints 20*e*–22*e* exposed thereby.

The upper joints, joints 20D–22D in tent poles 20–22, respectively, are above the upper ends of the respective seams so that ribs 27 and 28 do not interfere with the insertion of the tent poles into the sleeves. Accordingly, tent poles 20–23 are inserted into the respective sleeves and fabric tent shell 14 is suspended therein with cord 33 at the apex (as described with respect to FIGS. 2A–2C) while the lower end of each tent pole is secured with cord 42 as described at FIGS. 3A and 3B.

With foldable frame 12 mounted to fabric tent shell 14, tent 10 can be easily pitched at any desired location upon unfolding of tent poles 20–23 and engagement of ribs (as shown by ribs 27 and 28). Cords 33 and 42 are thus foreshortened as described exerting tension on fabric tent shell 14 to hold the same uniformly inside the volume described by foldable frame 12.

Folding of tent 10 is accomplished by folding ribs (ribs 27 and 28) to allow tent poles 20–23 to be brought generally parallel. Floor 18 is lifted at a center point to release the tension on cords 33 and 42 to provide sufficient slack so that tent poles 20–23 can be released at each joint and folded upwardly in sequence. By this manner, the tent is folded in a relatively compact shape having a length generally equal to the length of the respective segments of the tent poles.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A tent suspension system comprising:

a fabric tent shell comprising a plurality of fabric side walls, each side wall joined to an adjacent side wall in side-by-side relationship along a seam, and an integral fabric floor joined along a lower edge of said side wall;

a foldable frame means for supporting said fabric tent shell comprising a plurality of tent poles coupled together at the upper ends in a coupling;

sleeve means formed along said seams for receiving said tent poles;

rib means extending laterally between said adjacent tent poles, said rib means having sufficient length to place said tent poles under an outwardly directed bending moment as said tent poles are strained by said fabric and tent shell; and suspension means for suspending said fabric tent shell under tension within the foldable frame means comprising a mount means secured to said foldable frame means and an endless cord look means slidably engaged in pulley-like relationship between mount means fixedly secured on said foldable frame means and said fabric tent shell to place said fabric tent shell under tension when said foldable frame means is opened outwardly into an extended position with the ribs holding said tent poles under said outwardly directed bending moment, said cord means being slidably engaged in pulley-like relationship allowing said cord means to adjustably transfer said tension between said foldable frame means and said fabric tent shell.

2. The tent suspension system defined in claim 1 wherein said suspension means comprises an upper suspension system adjacent said coupling and comprising a first endless cord look slidably mounted to said fabric tent shell in a pulley-like relationship at a position adjacent the upper convergence of said seams and secured in a securement to at least two opposing tent poles at spaced relationship to said coupling so as to form a generally obtuse angle in said first cord when said foldable frame means is extended outwardly and a generally acute angle when said foldable frame means is folded inwardly, said first cord thereby providing an increased effective length between said foldable frame means and said fabric tent shell by a length approximately equivalent to a portion of the distance between said securement on said opposing tent poles.

3. The tent suspension system defined in claim 2 wherein said foldable frame means includes four tent poles and said fabric tent shell is mounted between opposing first and third tent poles with said first cord being slidably engaged between said first and third tent poles and to the second and fourth tent poles, thereby increasing the effective length of said first cord between said first tent pole and said second tent pole by a length generally equivalent to the lateral, spatial separation between said tent poles.

4. The tent suspension system defined in claim 1 wherein said suspension means comprises a basal suspension system adjacent the bottom of each tent pole and comprising a second cord secured at a first end adjacent said sleeve and at a second end adjacent said fabric floor with a spaced relationship between said first end and said second end, said second cord being slidably engaged in pulley-like relationship to a pole mount secured to said tent pole adjacent said bottom of said tent pole so that said second cord forms an accurate angle when placed under tension by the opening of said foldable frame means.

5. The tent suspension system defined in claim 1 wherein said sleeves comprise relatively narrow loops of fabric wherein said sleeves comprise relatively narrow loops of fabric extending incrementally from said seams a sufficient distance to telescopically receive said tent poles and said suspension means comprises cord means with a pulley-like relationship between said tent poles and said fabric tent shell to provide sufficient relaxation means in said cord means when said foldable framework means is folded with said tent poles essentially parallel so as to release tension on said tent poles.

6. The tent apparatus system defined in claim 1 wherein said sleeves extend upwardly along said seams to a point adjacent said rib means to thereby accommodate said tent poles and said ribs being assembled into said foldable frame means and said tent poles being inserted into said sleeves prior to engagement of said cord means in pulley-like relationship between said fabric tent shell and said tent poles.

7. A tent suspension system comprising:

a fabric tent shell comprising a plurality of fabric side walls, each side wall joined to an adjacent side wall in side-by-side relationship along a seam, and an integral fabric floor joined along a lower edge of said side wall;

a foldable frame means for supporting said fabric tent shell comprising a plurality of tent poles coupled together at the upper ends in a coupling;

sleeve means formed along said seams for receiving said tent poles;

an upper suspension means for suspending the upper portion of said fabric tent shell comprising a first endless cord look means connected in a pulley-like relationship between said fabric tent shell and at least two opposing tent poles in spaced relationship to said coupling; and a basal suspension means for pulling outwardly on each corner of said fabric tent shell comprising at each corner a second cord means connected at each end to said fabric tent shell with said ends in vertically spaced relationship, said second cord being looped in a pulley-like, sliding relationship through a retainer fixedly mounted on said tent pole.

8. A method for suspending a fabric tent shell in a foldable frame comprising:

forming said fabric tent shell by joining a plurality of fabric side walls with a seam along adjacent edges, each seam including a sleeve formed as an integral part thereof, and joining a fabric tent floor to the bottom edges of said fabric side walls;

preparing said foldable frame from a plurality of tent poles and lateral ribs extending laterally between adjacent said tent poles and coupling the upper ends of said tent poles;

inserting each tent pole into a sleeve;

suspending the upper end of said fabric tent shell from said foldable frame by mounting a first endless cord look in a pulley-like relationship between said fabric tent shell and fixed mounts on at least two tent poles in spaced relation so that opening of said foldable frame creates a lifting of said fabric tent shell; and stretching said fabric tent shell outwardly at each corner by mounting at each corner a second cord secured at a first end adjacent the fabric tent floor and at a second end vertically spaced from the first end and adjacent a lower end of said sleeve, said second cord slidably engaging a mount fixedly secured to said tent pole in a pulley-like relationship, said second cord stretching said fabric tent shell outwardly when said foldable frame is opened with the pulley-like relationship of said second cord uniformly distributing tension forces imposed on said second cord and said second cord relaxing tension on said fabric tent shell when said foldable frame is closed.

9. A tent suspension system comprising:

a fabric tent shell comprising a plurality of fabric side walls, each side wall joined to an adjacent side wall in a side-by-side relationship along a seam, and an integral fabric floor joined along a lower edge of said side wall;

a foldable frame means for supporting said fabric tent shell comprising a plurality of tent poles coupled together at the upper ends in a coupling;

sleeve means formed along said seams for receiving said tent pole;

rib means extending laterally between said adjacent tent poles, said rib means having sufficient length to place said tent poles under an outwardly directed bending moment as said tent poles are restrained by said fabric tent shell; and suspension means for suspending said fabric tent shell under tension within the foldable frame means comprising a mount means secured to said foldable frame means and cord means slidably engaged in pulley-like relationship between mount means fixedly secured on said foldable frame means and said fabric tent shell to place said fabric tent shell under tension, said foldable frame means including four tent poles and said fabric tent shell is mounted between opposing first and third tent poles with said cord being slidably engaged between said first and third tent poles and to the second and fourth tent poles, thereby increasing the effective length of said cord between said first tent pole and said second tent pole by a length generally equivalent to the lateral, spatial separation between said tent poles.

* * * * *